United States Patent [19]

Lajos

[11] Patent Number: 4,613,156

[45] Date of Patent: Sep. 23, 1986

[54] SKI POLE HANDLE

[76] Inventor: Thomas Z. Lajos, 2454 W. Oakfield Rd., Grand Island, N.Y. 14072

[21] Appl. No.: 716,081

[22] Filed: Mar. 26, 1985

[51] Int. Cl.[4] ..... A63C 11/22

[52] U.S. Cl. ..... 280/821; D8/DIG. 6

[58] Field of Search ..... 280/821, 822; D8/DIG. 6

[56] References Cited

U.S. PATENT DOCUMENTS

| | | | |
|---|---|---|---|
| 4,004,818 | 1/1977 | Ramillon | 280/821 |
| 4,037,850 | 7/1977 | Haberlin | 280/821 |
| 4,234,202 | 11/1980 | Loffelholz | 280/821 X |
| 4,493,494 | 1/1985 | Feagin, Jr. | 280/821 |

*Primary Examiner*—John J. Love
*Assistant Examiner*—Michael Mar
*Attorney, Agent, or Firm*—Diller, Ramik & Wight

[57] ABSTRACT

A ski pole handle which includes a main gripping portion defined by an upstanding elongated body having upper and lower body portions, opposite inboard and outboard lateral faces and opposite forward and rear faces; a generally tubular thumb-receiving channel disposed at the upper body portion, the elongated body defining a handle portion disposed beneath the thumb-receiving channel and being adapted to accommodate and be gripped between a skier's fingers and palm, the thumb-receiving channel having an inner bottom thumb-supporting generally convexly curved surface merging with the rear face whereby a person's thumb and particularly the phalanges, metacarpus and the associated ulnar collateral ligament of the metacarpo-phalangeal joint are protected against injury normally attributed to abduction/extension of the thumb which is the usual cause of typical collateral ligament injury resulting from a skiing fall, a pair of laterally outboard knuckle-protecting sheets, one ascending and depending to collectively define with the handle portion a protective area within which is disposed the knuckles of a skier's hand, and the lower body portion defining an upwardly facing edge along the forward, rear and outboard lateral faces for supporting the hypothenar surface of the skier's hand.

7 Claims, 8 Drawing Figures

SKI POLE HANDLE

Injuries to the thumb are quite common in skiing. Next to knee injuries, they are the most frequent in downhill skiing today. In an aritcle for the "International Journal of Sport's Medicine" (Volume 3, pp. 50-55, 1982), Doctors Engkvist, Balkfors and Lindsjo reported that thumb injuries constituted seventeen percent of all skiing injuries and that approximately three-quarters of thumb injuries were lesions of the ulnar collateral ligament of the metacarpophalangeal joint. Compared to a controlled population consisting of 1619 randomly chosen uninjured skiers, the writers' found that no type of ski pole handle in common use of the time of the investigation/study eliminated the risk of thumb injury, but the injury frequency was higher when using a ski pole with a big plate on the top of the handle. The investigation indicated, however, that it was of no importance how the skier gripped the ski pole in relation to the strap. The writers suggested that the skier during a fall holds onto the ski pole unit the very last moment before the hand hits the hardpack snow or ice. The ski pole handle then remains in the hand and constitutes the hypomochlium that forces the thumb into abduction and extension, which causes the typical ulnar collateral ligament tear.

Most importantly, the study set forth in the above-captioned publication specifically indicated that no ordinary type of ski pole handle in use at the time of the study eliminated the risk for thumb injury during a fall, nor did it matter how the skier gripped the handle. While ski pole handles with a broad plate on top caused a higher injury frequency than expected, it was interesting to note that this handle design was supposedly intended to diminish the risk for ligamental injuries when falling against the upper part of the ski pole. Therefore, to date it appears that specific ski pole handle designs have not obviated thumb injuries nor lessened the frequency thereof, but certainly the article emphasizes the necessity and the possibility of improving the design of ski pole handles to diminish the risk for thumb injuries during downhill skiing.

In keeping with the foregoing, a primary object of the present invention is to lessen and/or eliminate thumb injuries as a result of falls during downhill skiing by the provision of a novel ski pole handle which essentially entirely encases the skier's thumb and prevents injury normally attributed to abduction/extension of the thumb which is the usual cause of typical collateral ligament injuries resulting from a skiing fall.

In further accordance with this invention, the novel ski pole handle includes a main gripping portion defined by an upstanding elongated body having upper and lower body portions, opposite inboard and outboard lateral faces and opposite forward and rear faces; a generally tubular thumb-receiving channel disposed at the upper body portion, the elongated body defining a hand-gripped portion disposed beneath the thumb-receiving channel and being adapted to accomodate and be gripped between the skier's fingers and palm, and the thumb-receiving channel having an inner bottom thumb-supporting generally convexly curved surface merging with the rear face whereby a person's thumb and particularly the phalanges, metacarpus and the ulnar collateral ligament of the metacarpophalangeal joint are protected against injury normally attributed to thumb abduction/extension during a skiing fall.

Still another object of the present invention is to provide a novel ski pole as aforesaid wherein the thumb-receiving channel includes a rear-entry through which a person's thumb is inserted into the thumb-receiving channel, and a front opening through which a person's thumb is visible when seated within the thumb-receiving channel, although optionally the thumb opening can be closed by a wall.

Yet another object of this invention is to provide a novel ski pole handle of the type heretofore defined wherein the thumb-receiving channel is defined by inboard and outboard lateral walls joined at an upper apex whereby the entire thumb is totally enclosed and protected, although the lateral walls maybe separated from each other by a slot along the apex to permit the thumb to pass between the thumb-receiving channel lateral walls as the latter flex when a skier's hand is subject to a relative severe fall and attendant impact with the ground, snow, hardpack and/or ice.

Still another object of this invention is to provide a novel ski pole handle of the type heretofore set forth including a knuckle-protecting sheath of a one-piece construction or alternatively in the form of a downwardly projecting sheath, an upwardly projecting sheath or a combination of the latter two sheaths having adjacent terminal edges which collectively define with the hand grip an area within which the knuckles are housed and protected when the hand grip is gripped by a skier's hand.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
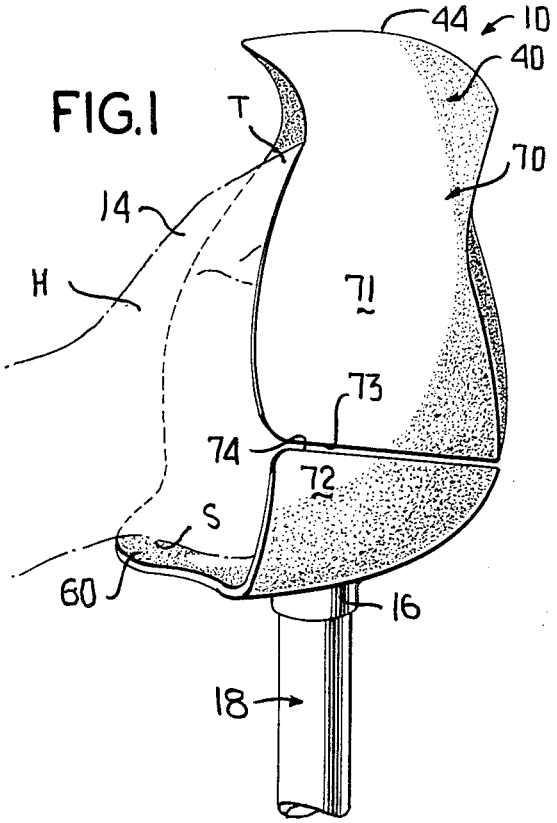
FIG. 1 is a side elevational view of a novel ski pole handle, and illustrates an upper thumb-receiving and protecting channel and a pair of lateral knuckle-protecting sheaths.

A novel ski pole handle or grip is generally designated by the reference numeral 10 and is preferably formed from a single homogeneous injection-molded or compression-molded body of rubber, plastic or similar material. The only criteria for the material is that it be sufficiently firm to maintain the overall shape/configuration of the ski pole handle 10, yet have a certain degree of limited flexibility for purposes which will be set forth more fully hereinafter.

The ski pole handle 10 illustrated in the drawings is a right-hand ski pole handle, and thus the description thereof hereinafter is, of course, equally applicable to an identical ski pole handle (not shown) which is constructed, arranged and shaped for utilization on the left-hand of a skier. In order to accurately describe the ski pole handle 10, the word "forward" means the direction which the ski pole handle 10 normally assumes when utilized by a skier when descending straight downhill, and the "rear" is the reverse thereof. Thus, the "forward" direction in FIGS. 5 and 7 of the drawings, for example, is to the left, whereas the "rear" direction is to the right.

The words "inboard" and "outboard" are used to designate the inside-most and outside-most lateral or side surfaces or faces of the ski pole handle 10, again with reference to the in-use position when a skier is holding the same in hand and pointing directly downhill. Insofar as the right-hand ski pole handle 10 of the drawings is concerned, the "inboard" lateral face, side or surface is the side shown in FIG. 5; and the "outboard" lateral side, face or surface is that shown in FIG. 1.

Figure 5:
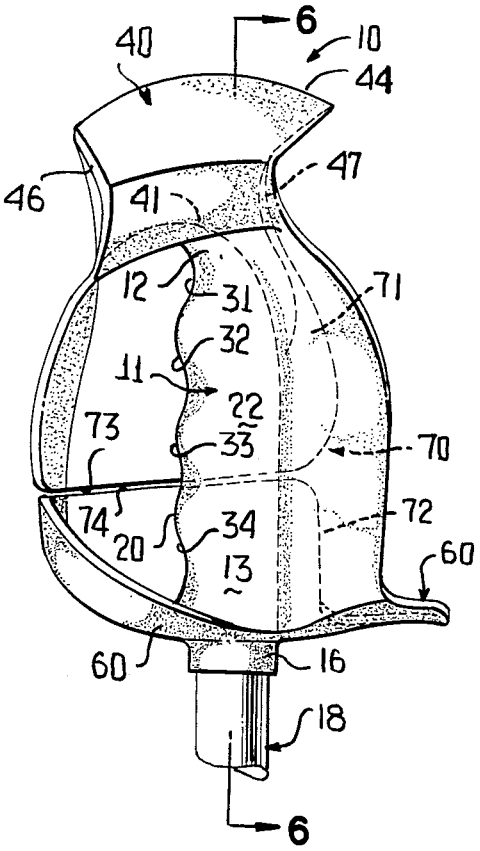
FIG. 5 is a side elevational view of the ski pole handle opposite that shown in FIG. 1, and illustrates further details of the ski pole handle including the thumb-receiving channel, the knuckle-protecting sheaths, and the hypothenar surface supporting ledge.
Figure 6:
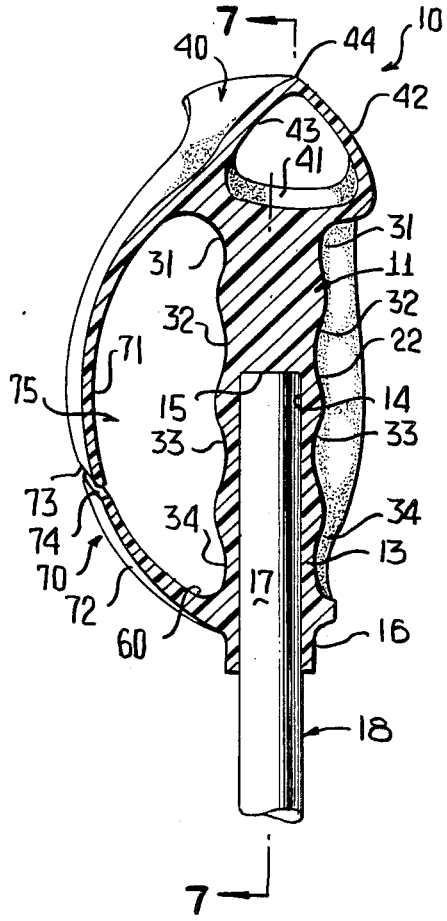
FIG. 6 is a cross-sectional views taken general along line 6—6 of FIG. 5, and the illustrates with more particularity the cross-sectional configuration of the thumb-receiving channel and the knuckle-accommodating area between the hand-gripped portion and the knuckle-protecting sheaths.

The ski pole handle 10 comprises a main gripping portion 11 (FIGS. 2, 4 and 5 through 7) formed as a generally upstanding elongated body having an upper body portion 12 and a lower body portion 13, the latter of which includes a generally cylindrical bore 14 having a blind end or face 15 and a tubular end portion 16 (FIG. 6). An end 17 of a tubular metallic ski pole 18 is inserted within the bore 14 and is preferably adhesively bonded thereto.

Figure 2:
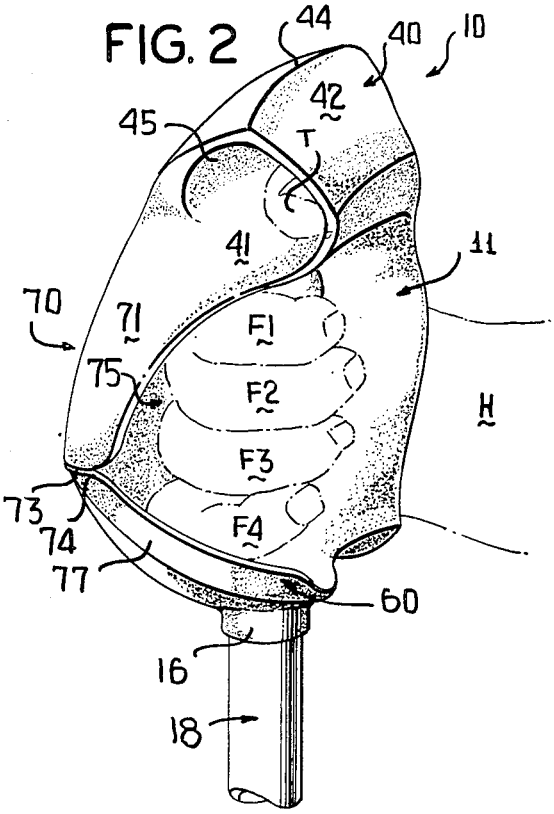
FIG. 2 is a front perspective view and clearly illustrates the manner in which the thumb, knuckles, and fingers are protected by the ski pole handle.
Figure 3:
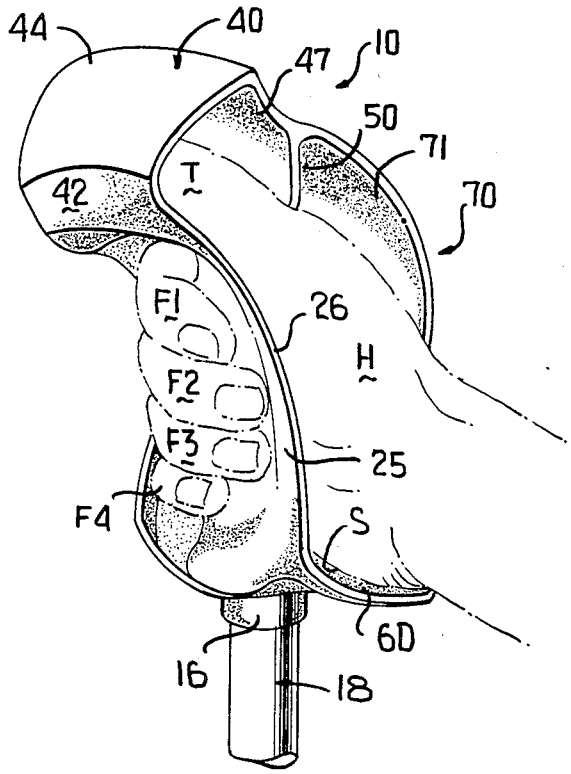
FIG. 3 is a side perspective view of the ski pole handle, and illustrates the manner in which the hypothenar surface of a skier's hand is supported by a lower ledge of the handle.
Figure 4:
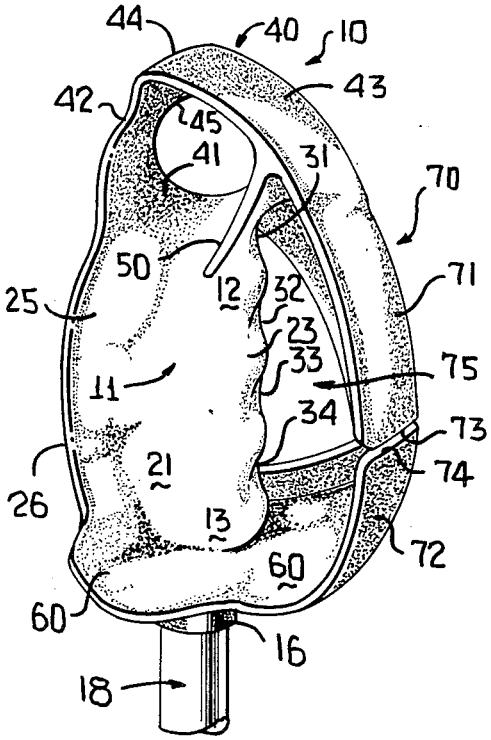
FIG. 4 is rear perspective view of a ski pole handle, and illustrates details of the thumb-receiving channel, the knuckle-protecting sheaths, and the contoured nature of the hand-grip portion to accommodate the skier's fingers.
Figure 7:
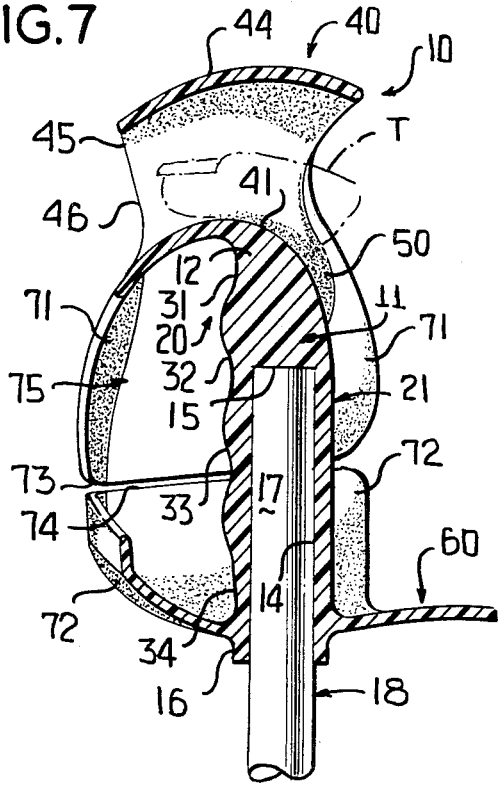
FIG. 7 is a cross-sectional view taken generally along lines 7—7 of FIG. 6, and illustrates the manner in which a rear face of the hand-gripped portion merges with a convex bottom-defining surface of the thumb receiving channel.
Figure 8:
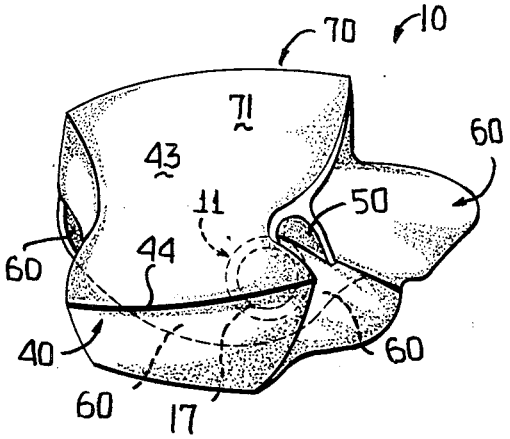
FIG. 8 is a top plan view of the ski pole handle, and illustrates a wall forming a smooth juncture between the thumb-receiving channel of the knuckle-accommodating area.

The main gripping portion or body 11 further includes a forward face or surface 20 (FIGS. 5 and 7), a rear face or surface 21 (FIGS. 5 and 7), and inboard and outboard lateral surfaces or faces 22, 23, respectively (FIGS. 3 through 6). The inboard lateral face 22 (FIG. 3) is the left-hand side of the right-hand ski pole 10 illustrated in the drawings, whereas the outboard lateral face or surface 23 (FIG. 4) is the right-hand side of the right-hand ski pole handle 10. The faces or surfaces 21, 23 (FIG. 4) gradually merge with each other to form a generally continuing surface without any abrupt lines of demarcation therebetween. The faces 21, 22 (FIG. 3) also collectively define therebetween an elongated side wall 25 having a progressively reduced cross-sectional thickness in a direction laterally outwardly from the main body portion 11 toward a generally vertical edge 26 (FIGS. 3 and 4). The forward face 20 and forward portions (unnumbered) of the faces 21, 22 are undulated, as is best illustrated in FIGS. 4 through 7 of the drawings, to provide generally four circumferential grooves or flutes 31 through 34 (FIGS. 5 through 7) for accommodating the fingers F1–F4 of a skier's hand H, as is depicted in FIGS. 2 and 3, and is equally apparent from FIGS. 5 through 7. The circumferential grooves or flutes 31 through 34 progressively blend smoothly with the inboard and outboard lateral faces 22, 23, respectively, as is best illustrated in FIGS. 4 and 5 of the drawings. A generally tubular thumb-receiving and protecting channel 40 is disposed at, above and as the top-most portion of the upper body portion 12, as is best illustrated in FIGS. 6 and 7 of the drawings. The thumb-receiving a protecting channel 40 includes an inner bottom thumb-supporting generally convexly curved surface 41 (FIG. 7) which merges with the rear face or surface 21, and supportingly accommodates thereupon a thumb T of a skier's hand H (FIGS. 2 and 3). The thumb-receiving and protecting channel 40 is further defined by an inboard channel-defining wall 42 and an outboard channel-defining wall 43 merging at an upper apex 44 (FIG. 6). The surface 41 and the walls 42, 43 of the thumb-receiving and protecting channel 40 totally accommodate, house and protect the skier's thumb T, particularly the phalanges, metacarpus and the ulnar collateral ligament of the metacarpophalangeal joint, thus protecting the same against the injury normally attributed to abduction/extension of the thumb which is the usual cause of typical collateral ligament injury when a skier falls and his/her hand strikes the ground, snow, hardpack and/or ice, etc. Thus, while the thumb T is visible through a front opening 45 (FIG. 1) of the thumb-receiving and protecting channel 40, an edge 46 (FIG. 7) defining the front opening is sufficient forward of the end of the thumb T to prevent injury during a fall. However, the thumb T can be readily withdrawn from the channel 40 through the rear opening 47 thereof. Hence, under both mild or severe impact condition of a skier's hand H against the ground, hardpack, etc., the thumb T is fully protected by the thumb-receiving and protecting channel 40, yet can be readily removed therefrom.

The ski pole handle 10 further includes a wall 50 (FIGS. 3 and 4) which descends downwardly from the wall 43 and progressively merges with the rear face 21 and the outboard lateral face 23 at a juncture therebetween, as is readily apparent from FIG. 4 of the drawings. The wall 50 additionally serves to support and protect the outboard side of the thumb T, but, more importantly, offers reinforcement for the channel 40 and particularly the wall 43 thereof of preclude inward deflection or collapse under severe ground-impact. Thus, the wall 40 is essentially a "beam" which prevents the walls 42, 43 or the apex 44 from being forcefully bent inwardly under high impact forces, thus assuring that the skier's thumb is not damages under extremely high ground-impacting forces during a skiing accident.

The ski pole handle 10 further includes means generally designated by the reference number 60 (FIGS. 3, 4, 5, 7 and 8) at the lower body portion 13 for supporting the hypothenar surface S of the skier's hand H. The means 60 is generally defined by a tongue, ledge or wall which virtually entirely surrounds the lower body portion 13 and projects rearwardly from the rear face 21, outwardly from the face 23, forwardly from the face 20 and laterally inwardly from the face 22. The hypothenar supporting ledge 60 is narrowest at the inboard face 22 and widest immediately adjacent the rear face 21 and the outboard lateral face 23, thus providing a wide surface area for the hypothenar surface S of the hand H and a narrower supporting surface for the finger F4 (FIGS. 2 and 4) and the remaining fingers F1 through F3 supported thereabove adjacent the inboard face 22.

Thus, the entire bottom edge (unnumbered) of the hand H when position as shown in FIGS. 2 and 3 is supported by the ledge or surface 60 substantially entirely about the entire circumferential extent of the lower portion 13 of the main gripping portion 11 of the ski pole handle 10. Therefore, the ledge 60 offers underlying supportive protection to the essentially entire underside of the hand H, including the little finger F4 and the hypothenar surface S.

The fingers F1 through F4 and the knuckles (unnumbered) thereof are also protected by covering means or sheath means 70 in the form of relatively flexible laterally and forwardly depending and ascending covers, sheaths or walls 71, 72, respectively. The sheaths 71, 72 include respective adjacent closely spaced edges 73, 74. The sheath 71 essentially is a continuation of the wall 43 (FIG. 4), while the sheath 72 is similarly an extension of the ledge 60. The sheaths 71, 72 collectively define with the faces 21, 23 an area or chamber 75 (FIGS. 2 and 4) which accommodates and protects the fingers F1 through F4 and the knuckles associated therewith. The fingers F1 through F4 can be readily withdrawn from the area 75 though they are protected therein by the sheaths 71, 72. However, under severe impact forces, it is desirable for the skier's hand H to perhaps be withdrawn laterally, rather than rearwardly, from the ski pole handle or grip, and to this end the sheaths 71, 72 are sufficiently flexible so that the gap (unnumbered) between the edges 73, 74 can flex momentarily to permit the hand to pass therethrough. Though not illustrated, the thumb-receiving and protecting channel 40 may also be provided with a gap similar to that between the edges 73, 74 by removing the apex 44 between the walls 42, 43 from the front to the rear in its entirety. This would then form a slot or a channel running from the front to the rear of the thumb-receiving and protecting channel 40 through which the thumb can pass during texture of the walls 42, 43 under high impact forces during a skiing fall.

In further accordance with this invention, the opening 46 of the thumb-receiving and protecting channel 40 can be closed by a wall (not shown) so the entire thumb T can be protected from forward-toward-rearward directed forces.

The ski pole handle or grip 10, when grasped as illustrated in FIGS. 2 and 3, will mitigate, lessen and otherwise preclude most typical collateral ligament injury resulting from a skiing fall. Due to the enclosure provided the thumb T by the thumb-receiving and protecting channel 40, the thumb and particularly the ulnar collateral ligament of the metacarpophalangeal joint are protected against injury which might otherwise occur as a result of the abduction/extension of the thumb under "normal" skiing falls with "standard" or "conventional" ski pole handles. Hence, an appreciable reduction in thumb injuries are provided by the novel and unobvious ski pole handle or grip 10 of the present invention.

Although in a preferred embodiment of the invention as has been specifically illustrated and described herein, it is to be understood that minor variations may be made in the apparatus without departing from the spirit and scope of the invention, as defined in the appended claims.

What is claimed is:

1. A ski pole handle comprising a main gripping portion defined by an upstanding elongated body having upper and lower body portions, opposite inboard and outboard lateral faces, a forward face and an opposite convexly curved rear face; a generally tubular thumb-receiving channel disposed at said upper body portion, said elongated body defining a hand-grip portion disposed beneath said thumb-receiving channel and being adapted to accommodate and be gripped between a skier's fingers and palm, said thumb-receiving channel having an inner bottom thumb-supporting generally convexly curved surface merging in continuity with said convexly curved rear face whereby a skier's thumb and particularly the phalanges, metacarpus and the ulnar collateral ligament of the metacarpophalangeal joint are protected against injury normally attributed to abduction/extension of the thumb which is the usual cause of typical collateral ligament injury resulting from a skiing fall; said thumb-receiving channel includes a rear-entry opening through which a person's thumb is inserted into said thumb-receiving channel and a front opening through which a person's thumb is visible when seated within said thumb-receiving channel; said thumb-receiving channel being additionally defined by a pair of spaced inboard and outboard lateral walls, said outboard lateral thumb-receiving channel wall merging progressively downwardly with a juncture surface between said rear face and said outboard lateral face, a laterally outboard knuckle-protecting sheath ascending both laterally and forwardly from said body lower portion, a laterally outboard knuckle-protecting sheath depending both laterally and forwardly from said thumb-receiving channel, said sheaths having spaced adjacent edges of sufficient flexibility for permitting the release therethrough of a skier's hand during a severe skiing fall, and means at said lower body portion defining an upwardly facing ledge along said forward, rear and outboard lateral faces for supporting the hypothenar surface and fingers of a skier's hand.

2. The ski pole handle as defined in claim 1 wherein said thumb-receiving inboard lateral wall merges with an edge wall which in turn merges with said ledge at said rear ledge face.

3. The ski pole handle as defined in claim 1 wherein said forward ledge face ends in an upwardly directed wall.

4. The ski pole handle as defined in claim 1 wherein said forward ledge face ends in an upwardly directed wall merging with said ascending knuckle-protecting sheath.

5. The ski pole handle as defined in claim 2 wherein said forward ledge face ends in an upwardly directed wall.

6. The ski pole handle as defined in claim 2 wherein said forward ledge face ends in an upwardly directed wall merging with said ascending knuckle-protecting sheath.

7. The ski pole handle as defined in claim 6 including a front wall closing said front opening of said thumb-receiving channel.

* * * * *